United States Patent [19]

Larsson

[11] Patent Number: 5,063,721

[45] Date of Patent: Nov. 12, 1991

[54] BRACKET FOR ATTACHMENT OF WALL LININGS

[76] Inventor: John A. Larsson, Kammakargatan 25, 1tr., Stockholm, Sweden, S-111 60

[21] Appl. No.: 460,884

[22] PCT Filed: Aug. 16, 1988

[86] PCT No.: PCT/SE88/00417

§ 371 Date: Feb. 26, 1990

§ 102(e) Date: Feb. 26, 1990

[87] PCT Pub. No.: WO89/01550

PCT Pub. Date: Feb. 23, 1989

[30] Foreign Application Priority Data

Aug. 20, 1987 [SE] Sweden ..... 8703240

[51] Int. Cl.[5] ..... E04B 1/38

[52] U.S. Cl. ..... 52/379; 52/714; 52/383; 248/218.1; 248/249; 211/106

[58] Field of Search ..... 248/249, 302, , 218.1; 211/106; 52/712–715, 383, 379, 380, 358, 489, 702, 410, 562, 383

[56] References Cited

U.S. PATENT DOCUMENTS

| | | | |
|---|---|---|---|
| 396,593 | 1/1889 | Norcross | 52/713 |
| 622,933 | 4/1899 | Twitchell | 248/249 |
| 727,852 | 5/1903 | Sharp et al. | 211/106 |
| 1,162,375 | 11/1915 | Legros | 248/218.1 |
| 1,434,915 | 11/1922 | Scholfield | 52/378 |
| 1,972,505 | 9/1934 | Wilson | 248/218.2 |
| 2,661,515 | 12/1953 | Nelsson | 52/358 |
| 3,300,939 | 1/1967 | Brynjolfsson et al. | 52/652 |
| 3,471,988 | 10/1969 | Allen | 52/562 |

FOREIGN PATENT DOCUMENTS

| | | | |
|---|---|---|---|
| 92759 | 2/1952 | Denmark . | |
| 46950 | 1/1988 | France | 52/712 |
| 338143 | 8/1971 | Sweden . | |
| 395941 | 8/1977 | Sweden . | |
| 398764 | 1/1978 | Sweden . | |
| 403310 | 8/1978 | Sweden . | |
| 423419 | 5/1982 | Sweden . | |
| 85022476 | 5/1982 | Sweden . | |
| 438695 | 4/1985 | Sweden . | |
| 455207 | 6/1988 | Sweden . | |
| 87/02403 | 4/1987 | World Int. Prop. O. . | |

*Primary Examiner*—James L. Ridgill, Jr.
*Attorney, Agent, or Firm*—Witherspoon & Hargest

[57] ABSTRACT

Bracket destined to be mounted on a wall to extend therefrom and so designed that a separately manufactured material in the form of sheets, such as a glass wool mat, is suspended on the bracket by pressing the material against the bracket and causing the material to be pierced by the bracket. The bracket is made out of bent wire (121, 122).

11 Claims, 5 Drawing Sheets

BRACKET FOR ATTACHMENT OF WALL LININGS

It is known to attach insulating sheets in the form of plates and webs on a wall with the aid of brackets extending from the wall, the sheets being attached to the wall by causing the brackets to extend through the sheets such as to form suspending means therefore. It has previously been suggested to manufacture the bracket from plate material.

In order to attach to the brackets a surface covering such as wall panel, facade, sheets of wood, plating, lacquered plate, but also for attaching a grid carrying plaster intended to form a finished wall surface, it is known from my Swedish patent application 85 02247-6 to provide the bracket with a recess into which an horizontally directed bar is inserted. The bar serves to retain a layer of insulating material which is pressed steadily onto the bracket and thereby is pierced by the bracket. The bracket also has a second recess for receiving a beam or bolt. The beam serves as a support in which the facade sheet or the like is anchored.

A disadvantage of the known bracket resides in the fact that it is difficult to set up and that it is relatively bulky whereby handling is troublesome and storing on the work place requires space.

Brackets for attachting only insultating material but not wall-facing material are known from e.g. SE-A 338 143, SE-A-403 310, SE-A-423 419. These known brackets are manufactured from wire and for attaching the insulation to the brackets separate ties are used which also are made of wire.

From SE-A-395 941 there is known a bracket manufactured from a plating through which the insulation is passed. When the insulating plate is in position, the plate strip is bent in order thus to achor the insultating sheet.

U.S. Pat. No. 3,471,988 shows a wire clamp intended to be inserting to a brick wall. Subsequently a wooden board is attached to the clamp. These clamps are in particular used around window and door openings in brick walls. Neither insulating slabs nor facade sheets are attached to the clamp.

In accordance with the present invention it is suggested to manufacture the bracket out of wire which is bent to such shape that it has sufficient strength to support the insulating slabs as well as any wall panel used. The bracket according to the invention has an attaching device intended to support a beam or cross bar retaining the perforated insulation against the wall and serving as a support for a facade sheet or the like.

One of the advantages obtained by the invention resides in the fact that the same type of bracket may be used throughout the whole wall and that various types of wall cover may be attached to the wall. In the central portion of the wall it is for example possible to attach facade panel of wood to the brackets, above, under the eave, panels of plating may be attached to the brakets and on the lower portion of the wall a plaster layer may be supported by the brackets. All these layers are provided on the outside of the insulating slabs attached to the brackets and a air gap exists between the insulating slabs and the facade cover.

In accordance with a preferred embodiment of the invention the position of the screw with which the bracket is anchored in the wall is shifted into the arm of the bracket so that the moments due to which the facade cover under the action of gravity tends to turn the bracket in the downward direction is compensated by maximum moments with which a negative pressure caused by wind acting on the wall tends to turn the bracket in an upward direction. This has the advantages that the force with which the screw is anchored in the wall may be reduced to only about 36 kg.

A bracket manufactured out of wire is resilient i.e. elastic in both the horizontal and vertical directions which means that the brackets absorb the temperature stresses to which the wall panels are exposed during respectively the day and the year. Hereby cracks in the wall facade are avoided.

Other advantages of the wire bracket according to the invention appear in connection with the attachment of the insulating slabs. When the brackets have been screwed into the wall the insulating slabs are attached by being pressed onto the brackets which are caused to cut through the insulating material. If the insulating material is in the shape of long lengths delivered in the form of a compacted roll, the entire roll is lifted to the top of the scaffold, whereafter the roll is opened and the whole length is released over the wall and attached to the brackets. When the whole wall has been covered with insulting material the transverse beams are inserted in the hooks of the bracket whereafter the insulating material is slightly compressed inwardly, about 7–8%. The compression is performed uniformly over the whole width of the insulating material whereby the insulating effect is enhanced. The longitudinal beams have such a cross-section as to be telescopically shiftable into each other facilitating a quick anchoring of the insulating material along extended horizontal lengths without time-requiring work for adapting the beams end-against-end or to saw the beams into suitable lengths. It is not necessary mutually to anchor the beams, it being sufficient to insert them into each other to a desired degree. The whole work of attaching the brackets to the wall, mounting the insulating slabs onto the brackets, anchoring the insulating slabs by means of the cross bars is extremely facilitated and requires short time because no sawing is required of either the insulating material or the beams. In window and door openings the insulating material is cut away and removed. No conventional cross-bars are needed for insulating purposes. No thermal bridges will be formed as no conventional cross-bars are used, whereby the insulating effect is improved. Also the mounting of the wall panels or the like is facilitated because they may be placed against two beams vertically spaced from each other and thereafter be attached e.g. by means of rivets without exact fitting work. Suitably the side edges of the wall panels are disposed in overlapping relation to the side edges of the insulating sheets to prevent formation of thermal bridges.

Hereafter the invention will be described by reference to the attached drawings in which FIGS. 1 and 2 are side views of a bracket according to the invention in two mounting phases, FIG. 3 is a side view of another embodiment of the invention, FIGS. 4 to 8 are perspective views of various additional embodiments of the invention, FIG. 9 is a perspective view of another embodiment of the bracket according to the invention, FIG. 10 is an elevational view of a bracket according to FIG. 9, FIG. 11 is a front view of the bracket according to FIG. 9, FIG. 12 is a perspective view of another embodiment of the bracket according to the invention, FIG. 13 is an elevation of the bracket according to FIG. 12, FIG. 14 is an elevational view of another embodiment of the bracket according to the invention, FIG. 15 is a plan view of a wall on which the brackets according to the invention have been mounted whereafter insulating material and wall panel have been attached to the brackets, FIG. 16 is a perspective view of another embodiment of the bracket according to the invention, FIG. 17 is a perspective view of the bracket when used for supporting a grid serving as a frame work for a layer of plaster, FIG. 18 is a side view of the bracket when used for attaching a grid with the aid of a spacing element, said grid serving as a frame work for the layer of plaster, FIG. 19 is a perspective view of the spacing element shown in FIG. 18, FIG. 20 shows the spacing element according to FIG. 19 attached to the bracket in the way illustrated in FIG. 18 and, FIG. 21 shows the bracket according to the invention provided with a tie known in itself for anchoring a brick in a brick facade not shown.

The bracket is made out of wire which, for example, may have a thickness of 4 to 5 mm. For outside facades it is suitable that the wire is of rustless steel. The bracket comprises an upper and a lower part. The lower part forms a vertical portion 10, a horizontal portion 11 and an end portion 12 which is S-shaped. The upper part comprises an inclined portion 13 and an S-shaped portion 14. The upper and lower portions are united by welds at 15 and 16. At its upper end the bracket is provided with an eye 17 to receive a screw or other fastening means to suspend the bracket on a wall 18.

The end portion 12 is shaped to carry a plate beam 20 for attaching a panel 21. In FIG. 1 the portion 14 is bent backward so that the beam 20 may be applied and in FIG. 2 the portion 14 has been bent outwardly to retain the plate beam 20. Insulating sheets are provided between the wall 18 and the beam 20.

FIG. 3 shows an embodiment of fundamentally the same type but with a modified shape of the end portion and the plate beam. In this case the bracket requires no bending in order to retain the plate beam 30 which is inserted in the position 31 shown in broken lines and is swung in the direction of arrow 32 to the position 30.

Fundamentally the system is intended to form av stable unit of substantially triangular shape. The advantages obtained by using wire instead of plating reside in the fact that it will be cheaper to manufacture the bracket out of rustless steel if it has the shape here suggested.

FIG. 4 shows an embodiment composed of two bent wires 41 and 42 shaped to form the same type of bracket as shown in the previous Figures, the fastening device for the plate cross-bar 43, shown in broken lines, being of substantially the same type. The wires form substantially a rectangular triangle where wire 41 forms the longer side and wire 42 the shorter side. The wires are laterally connected by welding at the meeting points 44 and 45. The ends of wire 41 form two eyes, an upper eye 46 and a lower eye 47. In the position shown of the bracket the upper eye 46 serves to suspend the bracket on a holding element on the wall, whereas the lower eye 47 acts as a support of the cross-bar 43. It is a purpose of this embodiment to enable the bracket to be turned so that the eye 47 is turned upwardly against the wall and the eye 46 down. By shaping the two branches 48 and 49 of the wire 42 with different lengths, the bracket may be adapted to two different thicknesses of the insulation. The ends 50 and 51 of the wire 42 are bent to retain the cross-bar 43.

Figure 8:
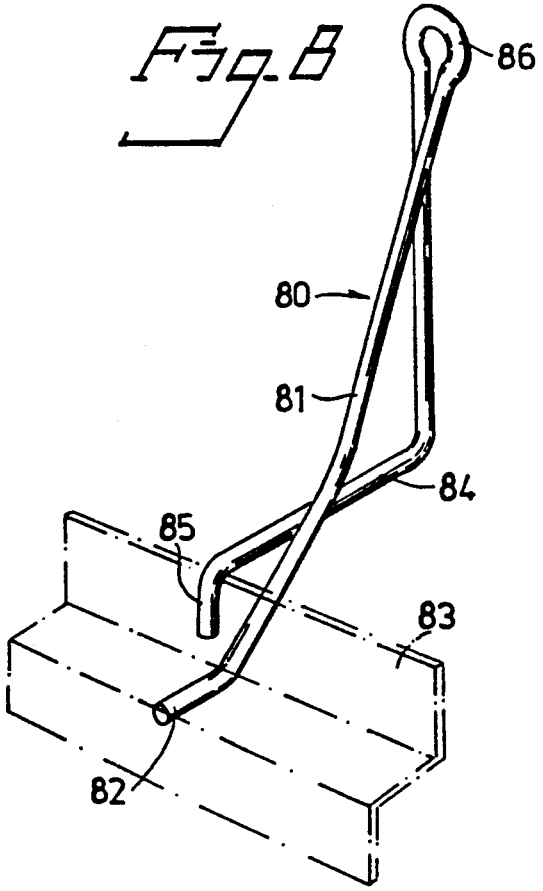

FIG. 8 shows a bracket of a different type compared to the brackets according to FIGS. 4 to 7, said bracket 80 being bend from a single wire. The branch 81 of the wire forms at its lower end a support 82 for a plate cross-bar 83, part of which is shown in broken likes. The upper portion of branch 81 forms the long side of the rectangular triangle, the short sides of which are formed by the other branch 84. The free end of branch 84 forms a hook 85 retaining the cross-bar 83. An eye 86 is arranged at the transition between the branches 81, 84.

Figure 1:
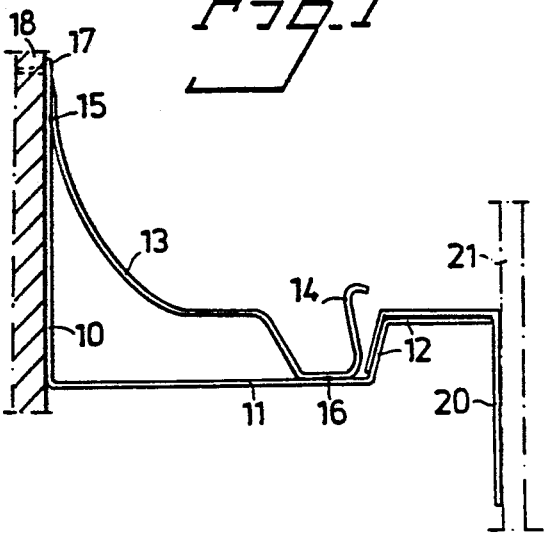
Figure 2:
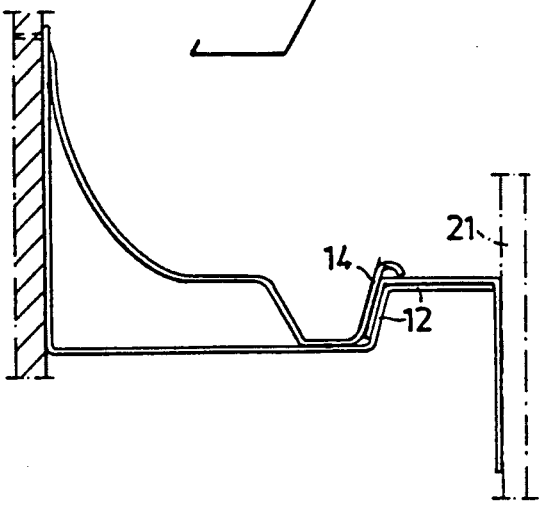
Figure 3:
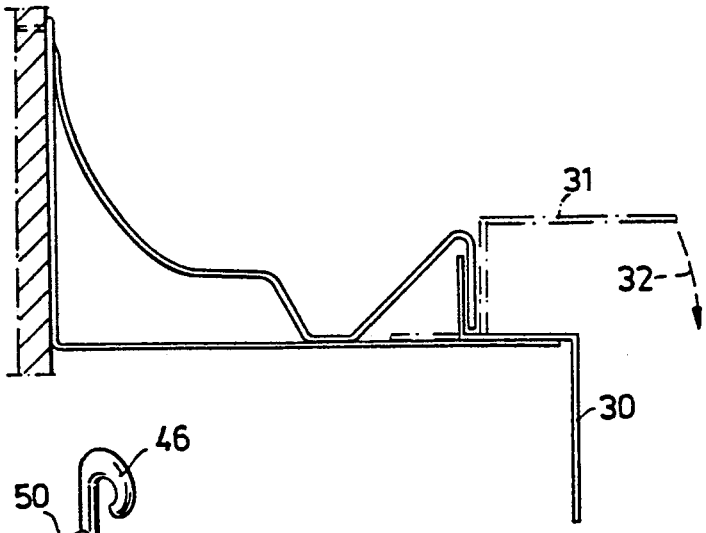
Figure 4:
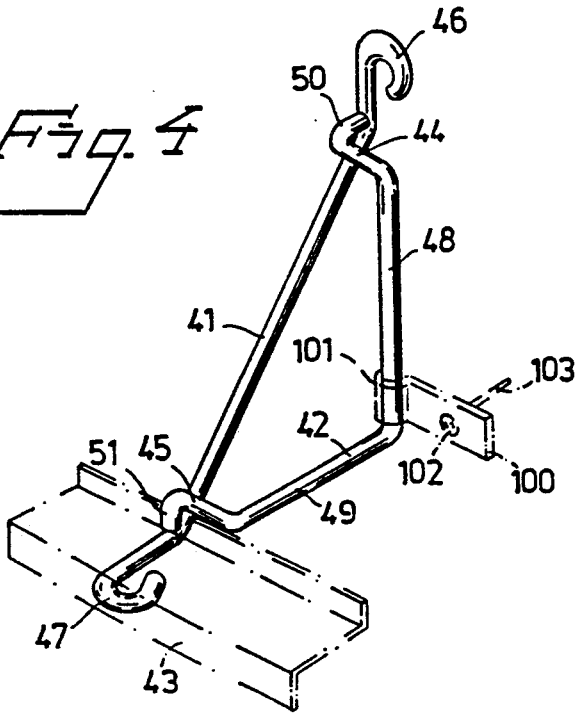

It may happen that a facade is exposed to negative pressure on the outer surface tending to draw the panel the in outward direction. In the brackets so far described this would mean that the lower end of the bracket is drawn outward and that the bracket will turn in an outward-upward direction about its suspension point at the upper end. In order to avoid this it is suitable the use a separate clamp attaching the lower end of the bracket to the wall. Such a clamp is shown in FIG. 4 where clamp 100 is shaped as a plate which at its one end is deformed into a hook 101 catching the bracket and is provided with a screw hole 102 enabling the clamp to be attached by means of a screw 103 to the wall.

Figure 5:
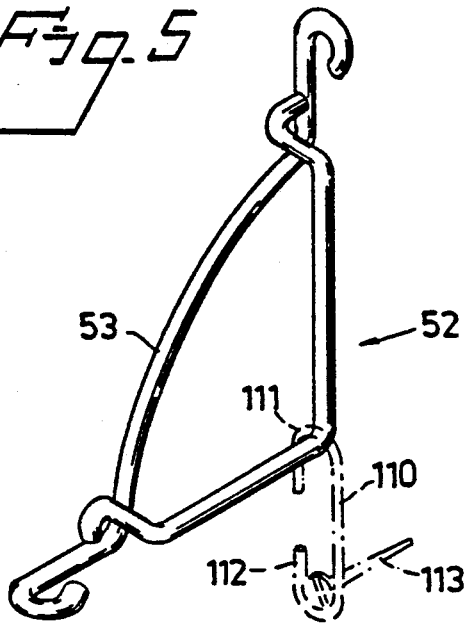
FIG. 5 shows a similar bracket 52 distinguished from the bracket according to FIG. 4 by the fact that the long side 53 of the triangle is outwardly bent.
Figure 6:
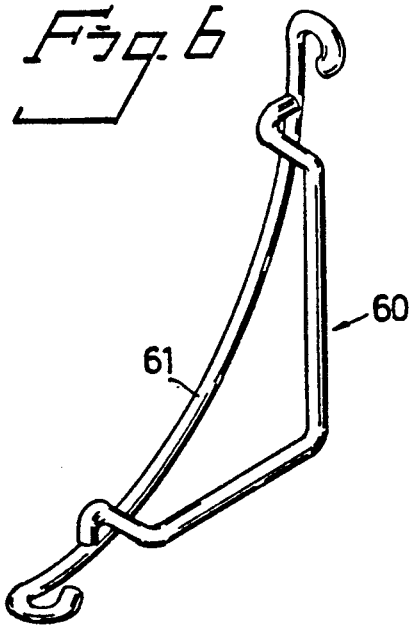
FIG. 6 shows another modification of the bracket according to FIG. 4 distinguished from the latter by the fact that the long side 61 is outwardly concave.
Figure 7:
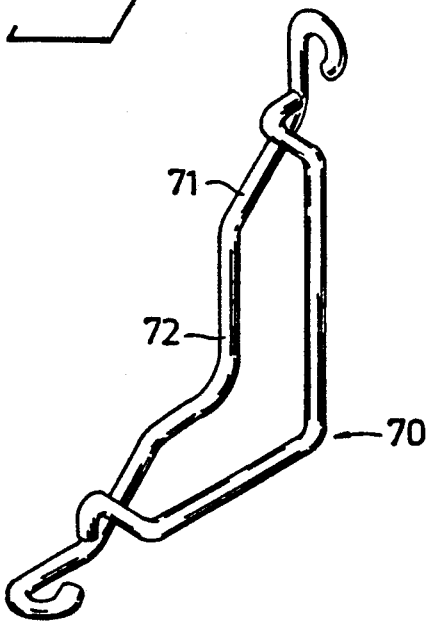
FIG. 7 shows another modification of the bracket in which the long triangle side 71 is shaped with a partial inward bending 71 in the middle. The purpose of this is to render the bracket flexible.

In FIG. 5 there is shown a different type of clamp 110 for the same purpose. It comprises a wire bent into two hooks, one 111 of which extends around the bracket at its lower corner whereas the other one 112 is attached by means of a screw 113 to the wall below the bracket. It is the purpose of this embodiment that the upper attachment screw of the bracket (not shown) should be spaced to the greatest extent possible from the attachment screw of the clamp thereby to reduce the risk that the pulling force acting on the bracket should brake loose a wall portion between the screws. Such risk is imminent if the walls comprise a material of low tensile strength.

The number of clamps of the types 100 and 110 may be chosen in consideration of the tensile forces that may be calculated to act onto the walls and may even be adapted to the weight of the panel. A heavy panel yields a greater weight counteracting the lifting of the bracket about their upper supspension point so that the number of clamps 100 och 110 may be less than in the case of a light-weight panel. It may be emphasized that even if the clamps 100 and 110 have been shown only in combination with one of the brackets, both clamps may be used in connection with any of the brackets shown.

The device shown may generally be used to attach a layer of material to a wall and is specifically suitable for material in the form of mats for heat insulation, such as glass fiber or glass wool mats which are permeable in such a way that the bracket permeates the mat when it is pressed against the bracket.

Figure 9:
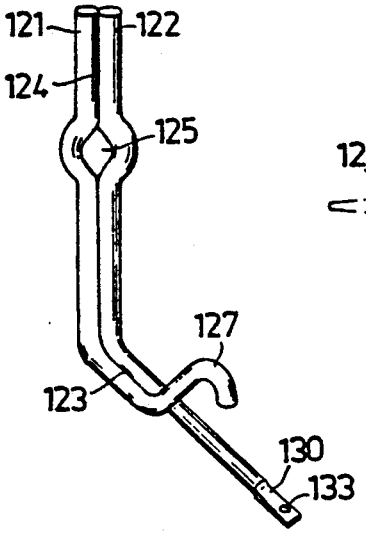
Figure 10:
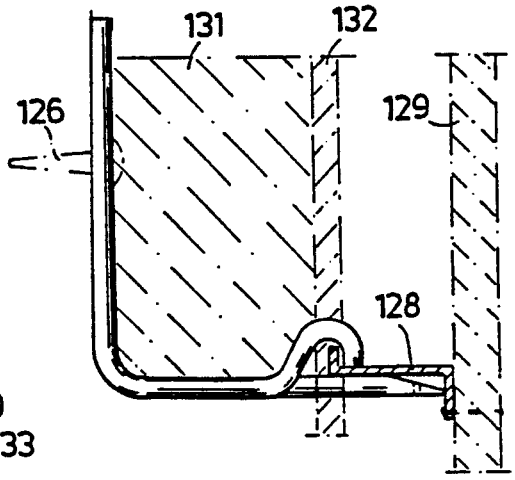
Figure 11:
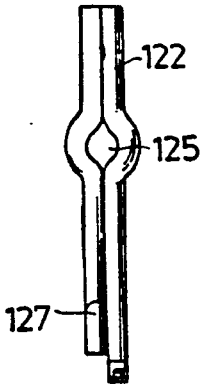

FIG. 9 shows another embodiment of a bracket in which two wires 121, 122 of acid-resistant rustless steel, quality 3343, by means of welds 123, 124 are connected in a side-by-side position to form a bracket. In the vertical portion of the bracket the wires are bent to form an eye 125 through which a screw 126 shown in FIG. 10 is intended to be inserted to attach the bracket to the wall. In the horizontal portion of the bracket the wire 121 is bent to form a hook 127 intended to receive the Z-shaped beam 128 shown in FIG. 10 onto which a facade sheet 129 is attached, for example by rivets. In the horizontal portion of the bracket the end portion 130 of wire 122 is bevelled to form an edge intended to cut throught the insulation sheet 131 which on the outward side may be covered by a rigid facade material 132 such as plastic. The web of beam 128 establishes an air gap between the outer surface of the insulating sheet 131 and the inner surface of the facade material 132. The end 130 (FIG. 9) has a through opening 133 enabling a plaster-supporting grid (shown in FIG. 17) to be attached, e.g. by means of wire elements, (the facade sheet 129 and the beam being omitted in this case). The plaster is placed to the desired thickness outwardly of the grid whereby the plaster will be freely suspended and supported by the bracket enabling the plaster to take part in the thermal expansion of the facade. The insulating material suitably has such thickness that the grid is in contact with the insulating material. In this case there is no air gap between the plaster layer and the insulation. FIG. 10 shows how the insulation is secured behind beam 128 on the level of the hook 127. The position of the eye 125 on the vertical portion of the bracket is an important factor and is so chosen that the gravitational, downwardly directed moment is balanced by the upward moment acting onto the facade sheet when the wind is blowing to exert a negative pressure on the wall facade. The screw 126 in this case only requires a holding force of about 36 kg. This means that if the screw is pulled in a straight outward direction in the normal plane of the wall, the retaining force acting on the screw only needs to amount to about 36 kg.

Figure 12:
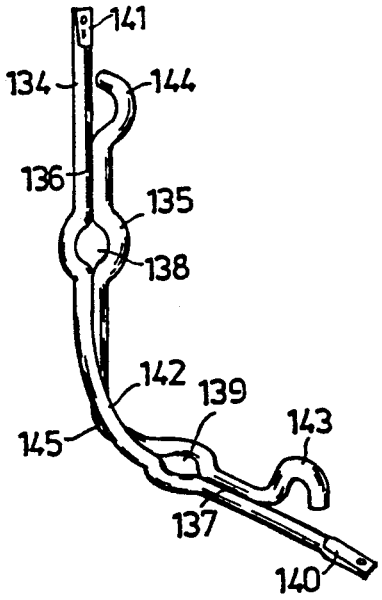
Figure 13:
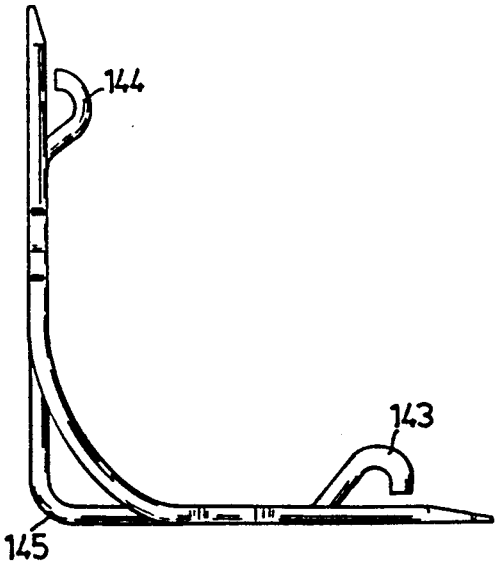

FIGS. 12 and 13 show a bracket similar to that shown in FIGS. 9 and 10 in that the wires 134 and 135 are positioned side by side and welded together at 136 and 137. The vertical and horizontal portions of the bracket have equal length causing the bracket to be symmetric so that it does not matter how it is oriented when it is screwed onto the wall. The wires are bent to form eyes 138, 139 for receiving screws. The wire 134 forms the points 140, 141 of the bracket which are bevelled to form an edge passing through the insulating sheet and which have an aperture each similar to the aperture shown in FIGS. 9 and 10 for attaching, for example, a plaster-supporting grid. Wire 134 has a bent portion 142 contributing towards stiffness and resiliency of the bracket in the vertical direction. Wire 134 is bent at either end to form one hook 143, 144 each similar hook 127 in FIG. 9. The wire 135 is bent rectangularly at 145.

Figure 14:
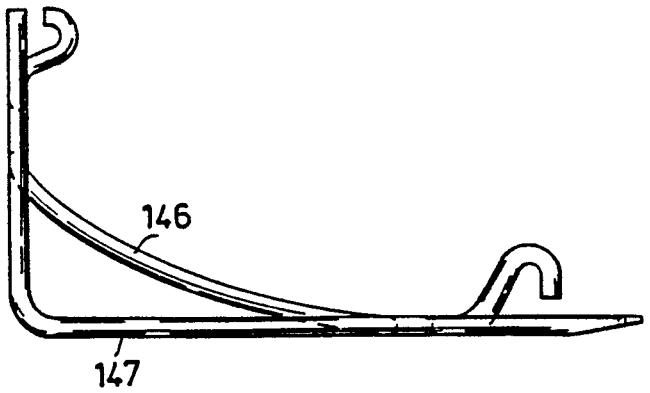

FIG. 14 shows another embodiment of a bracket comprising two wires 146, 147 positioned side by side. The structure is identical with that shown in FIGS. 12 and 13 except for the fact that the vertical portion (in the orientation of the bracket as shown in FIG. 14) is shorter than the horizontal portion. This offers the previously mentioned advantage that the same bracket may be used for two different thicknesses of the insulation material. Thus, wire 146 has an hook at either end whereas wire 147 is bevelled at both ends to form cutting edges.

Figure 15:
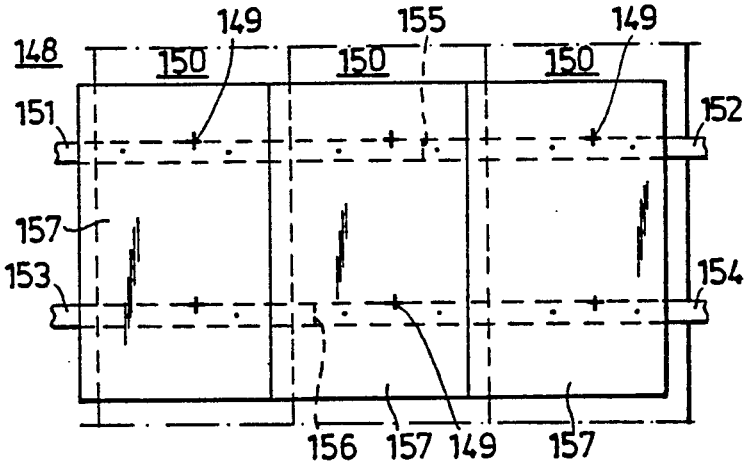

FIG. 15 shows a wall 148 into which a number of cross-marked bracket 149 are screwed. Lengths of insulating material 150 are suspended on the horizontal portions of the brackets. In the Figure there are shown three lengths or mats 150 of insulating material disposed side by side tightly adjacent each other in a non-overlapping relation. Subsequently beams 151, 152, 153, 154, of e.g. aluminium, have been inserted into the hooks of the brackets to anchor the insulation. It is to be noted that the beams 151 and 152 telescopically are inserted into each other and that the joint shown at 155 and 156 respectively is not a butt joint. Thus no cutting of the beams is required at the corners of the wall. Subsequently facade sheets 157 (of which 3 are shown in FIG. 15) are attached by rivets (indicated by dots) on the outside of the beams in the way shown in FIG. 10. The butt-joints between the facade sheets are laterally shifted in relation the butt-joints between the insulating mats 150 in order to eliminate thermal bridges.

Figure 16:
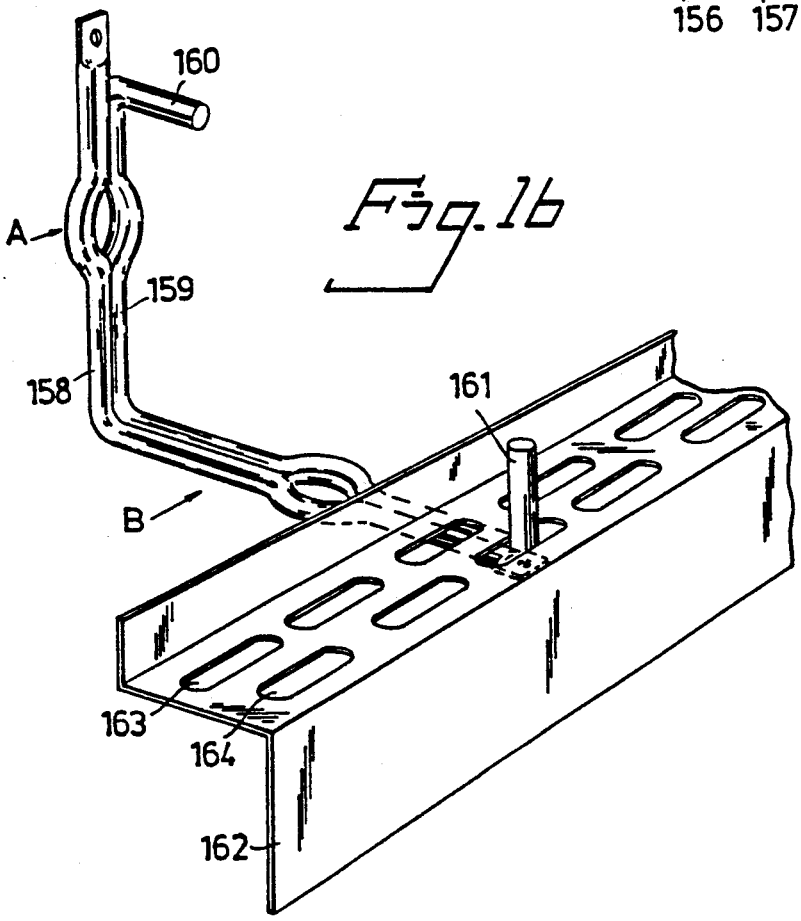

FIG. 16 shows an embodiment similar to that shown in FIG. 12 with the exception that both wires 158, 159 of the bracket are bent rectangularly and that the hooks 160, 161 of the bracket extend at right angles and thus are not circularly bent. The vertical portion A of the bracket is slightly shorter that the horizontal portion B. The bracket is intended to be used together with a Z-shaped beam 162 the web portion of which has two rows of elongated through-openings designated 163 for the inner row and 164 for the outer row. The beam 162 is placed over hook 161 so that either the inner row 163 of openings or the outer row 164 of openings is engaged with the hook 161. In the former case the bracket may be used together with an insulation having a first thickness and in the latter case together with an insulation having a second thickness different from the first one. Alternatively the bracket according to FIG. 16 may be used in such a way that the section B forms the vertical portion. If the Z-beam 162 shown in FIG. 16 is used to squeeze the insulation, the insulation may have a third thickness different from both the first and second thicknesses or a forth thickness different from both the first, second and third thicknesses depending on whether the beam is suspended on the hook 160 with its inner row 163 or outer row 164 of openings.

Figure 17:
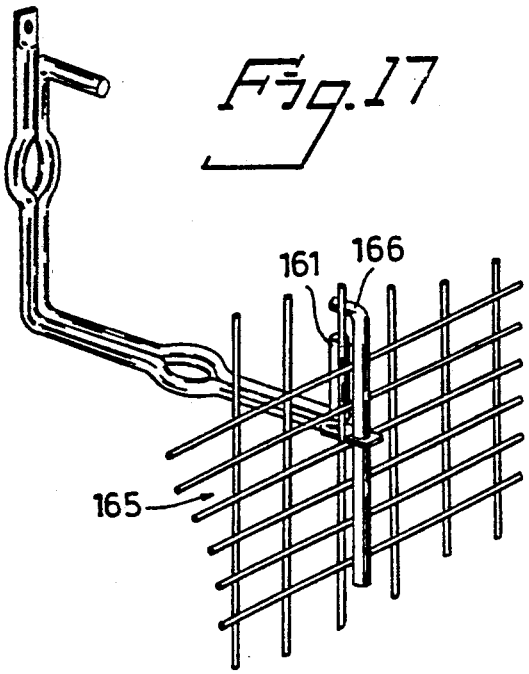

FIG. 17 shows how the bracket according to FIG. 16 may be used to attach a grid 165 with the aid of wire elements 166 having the shape shown and being inserted through the hole 133 in the bracket. The hook 161 of the bracket serves as support for the wire structure. A plaster layer (not shown) is thereafter applied to the grid 165. Between the wall and the grid 165 the previously mentioned insulation, not shown in FIG. 17, is supported.

Figure 18:
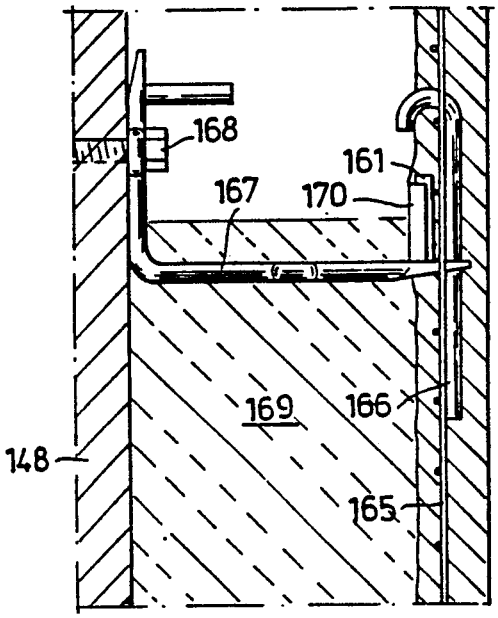
Figure 19:
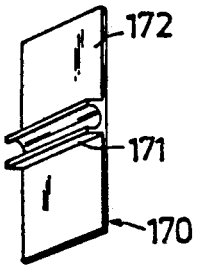
Figure 20:
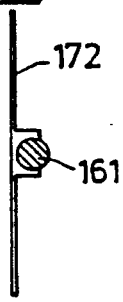

FIG. 18 shows an arrangement similar to that of FIG. 17. The bracket 167 is mounted on the wall by means of a screw 168. The insulation 169 has a thickness essentially corresponding to the spacing between the wall 148 and the hook 161 of the bracket. A spacing element 170 is clamped onto the hook. The spacing element 170 has the general shape as shown in FIGS. 19 and 20 and is preferably made of plastic. The spacing element 170 has a clamping portion 171 formed as a rib provided with a groove clamped about the hook 161 of the bracket. Moreover the spacing element has an outer portion 172 serving to compress the insulation slightly towards the wall 148. This causes the wire meshing 165 to lose contact with the insulation 169 which means that an air gap is formed therebetween. The wire meshing is retained between the hook 161 and the wire element 166. When plaster is applied a portion thereof will penetrate through the opening of the wire meshing and the grid thus will be positioned some distance into the plaster layer to serve as armouring therein. This armouring is stronger than that achieved by the embodiment according to FIG. 17.

Both in the embodiment according to FIG. 17 and that according to FIG. 18 the plaster layer will be supported by the horizontal portion of the brackets. Thus, the plaster layer will not hang down towards and with its total weight press against and thereby damage the insulation but the plaster layer is freely supported by the brackets. This is an important feature of the invention.

Figure 21:
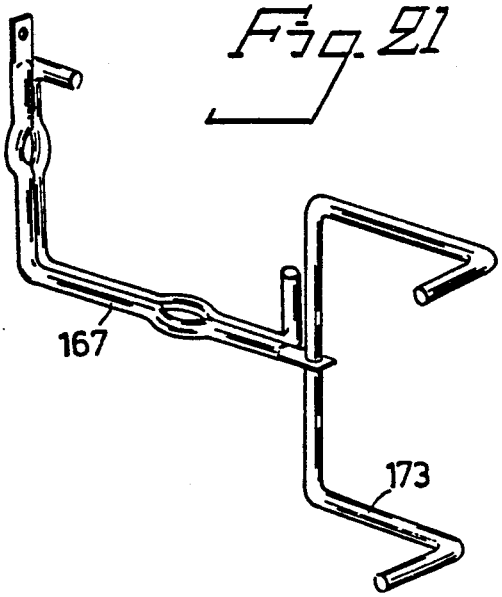

Finally FIG. 21 shows how the bracket according to the invention may be provided with a tie 173 of a type known in itself. The tie is passed through the opening 133 of the bracket and serves to retain a brick of a brick wall.

The invention may be modified and varied in many ways within the frame of the protective range of the claims.

I claim:

1. An angled support device having a first leg adapted to be fastened to a surface and a second leg adapted to support and retain in place relative to said surface at least one material, said angled support device comprising:

a first wire and a second wire welded together side by side, each wire having a first end and an opposite second end and being bent therebetween into an angled bracket member, a first length of said first wire and a first length of said second wire extending to said first end and forming a first leg of said angled bracket member, and a second length of said first wire and a second length of said second wire extending to said opposite second end and forming a second leg of said angled bracket member, said first length of said first wire and said first length of said second wire extending away from each other at a position along said first leg to provide a first aperture through said first leg;

means at said second length of said first wire for supporting said material, including a segment of said first wire at said opposite second end which is substantially straight; and means at said second length of said second wire for retaining said material relative to said first wire, including a segment of said second wire at said opposite second end which comprises a first bent portion.

2. The angled support device of claim 1 wherein the opposite second end of said first wire extends beyond the opposite second end of said second wire.

3. The angled support device of claim 1 including means for stiffening said angled bracket member in a vertical direction relative to said surface, including a third bent portion of at least one wire of said first wire and said second wire, said third bent portion extending from said first leg to said second leg.

4. The angled support device of claim 1 wherein said segment which is substantially straight includes an opening therethrough.

5. The angled support device of claim 1 further including means for urging said material towards said surface, including a spacing element having a clamping portion attached to said segment which forms said first bent portion.

6. The angled support device of claims 1 further including a beam having a generally Z-cross-sectional configuration including a first arm and a second arm connected by a web, said first arm being coupled to said segment which forms said first bent portion and said web being supported by said segment which is substantially straight, whereby said second arm provides means for attachment to a surface.

7. The angled support device of claim 1 wherein said second length of said first wire and said second length of said second wire extend away from each other at a position along said second leg to provide a second aperture through said second leg, and further including:

means at said first length of said first wire for supporting said material, including a segment of said first wire at said first end which is substantially straight; and means at said first length of said second wire for retaining said material relative to said first wire, including a segment of said second wire at said first end which comprises a second bent portion.

8. The angled support device of claim 7 wherein the length of said first leg is greater than the length of said second leg.

9. The angled support device of claim 1 wherein the opposite second end of said first wire extends beyond the opposite second end of said second wire, and further wherein the first end of said first wire extends beyond the first end of said second wire.

10. The angled support device of claim 9 wherein the length of said first leg is greater than the length of said second leg.

11. A bracket adapted to be fastened to a wall to support and retain in place relative to said wall at least one material, said bracket comprising a first wire and a second wire welded together side by side, said first wire being bent away from said second wire at least at one position along said first wire to form at least one eye, said first wire and said second wire being further bent to form a pair of first legs which include said at least one eye for attachment to said wall, and a pair of second legs extending at an angle from said pair of first legs for supporting and holding in place said at least one material, said first wire of said second leg having an end portion which includes a straight support segment and said second wire of said second leg having an end portion which includes a bent retaining segment.

* * * * *